US008476214B2

(12) United States Patent
Lynch et al.

(10) Patent No.: US 8,476,214 B2
(45) Date of Patent: Jul. 2, 2013

(54) LOW VOC HARD SURFACE TREATING COMPOSITION PROVIDING ANTI-FOGGING AND CLEANING BENEFITS

(75) Inventors: Loretta G. Lynch, Racine, WI (US); Sandra J. Demant, Franksville, WI (US); Jacqueline V. Lepow, Franklin, WI (US); Anne T. Maghasi, Buffalo Grove, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 2 days.

(21) Appl. No.: 12/926,021

(22) Filed: Oct. 21, 2010

(65) Prior Publication Data

US 2011/0098206 A1 Apr. 28, 2011

Related U.S. Application Data

(60) Provisional application No. 61/272,696, filed on Oct. 22, 2009.

(51) Int. Cl.
*C11D 3/44* (2006.01)

(52) U.S. Cl.
USPC ..... 510/180; 510/163; 510/181; 510/182; 510/238; 510/243

(58) Field of Classification Search
USPC ..... 510/163, 180, 181, 182, 238, 243
See application file for complete search history.

(56) References Cited

U.S. PATENT DOCUMENTS

| | | | | |
|---|---|---|---|---|
| 3,251,779 | A | 5/1966 | Williams | |
| 3,819,522 | A * | 6/1974 | Zmoda et al. | 510/182 |
| 4,054,534 | A | 10/1977 | Angelini | |
| 4,213,873 | A | 7/1980 | Church | |
| 4,239,659 | A | 12/1980 | Murphy | |
| 4,315,828 | A | 2/1982 | Church | |
| 4,606,842 | A * | 8/1986 | Keyes et al. | 510/182 |
| 4,978,469 | A | 12/1990 | Seaman, Jr. | |
| 4,983,317 | A * | 1/1991 | Requejo et al. | 510/419 |
| 5,252,245 | A | 10/1993 | Garabedian, Jr. et al. | |
| 5,298,182 | A | 3/1994 | Tsao et al. | |
| 5,342,549 | A | 8/1994 | Michael | |
| 5,362,422 | A | 11/1994 | Masters | |
| 5,364,551 | A | 11/1994 | Lentsch et al. | |
| 5,382,376 | A | 1/1995 | Michael et al. | |
| 5,411,597 | A | 5/1995 | Tsao et al. | |
| 5,411,598 | A | 5/1995 | Tsao et al. | |
| 5,437,807 | A | 8/1995 | Garabedian, Jr. et al. | |
| 5,468,423 | A | 11/1995 | Garabedian, Jr. et al. | |
| 5,523,024 | A | 6/1996 | Garabedian, Jr. et al. | |
| 5,540,865 | A | 7/1996 | Michael | |
| 5,585,342 | A | 12/1996 | Choy et al. | |
| 5,674,826 | A | 10/1997 | McMullen et al. | |
| 5,705,470 | A | 1/1998 | Faris | |
| 5,714,448 | A | 2/1998 | Choy et al. | |
| 5,750,482 | A * | 5/1998 | Cummings | 510/182 |
| 5,795,853 | A * | 8/1998 | Denis et al. | 510/182 |
| 5,817,615 | A * | 10/1998 | Garabedian et al. | 510/503 |
| 5,846,919 | A | 12/1998 | Tsao et al. | |
| 5,849,681 | A | 12/1998 | Neumiller et al. | |
| 5,851,981 | A | 12/1998 | Choy et al. | |
| 5,952,287 | A | 9/1999 | Gross et al. | |
| 5,977,050 | A | 11/1999 | Faris | |
| 5,990,072 | A | 11/1999 | Gross et al. | |
| 6,194,362 | B1 | 2/2001 | Trinh et al. | |
| 6,224,685 | B1 | 5/2001 | Gross et al. | |
| 6,277,800 | B1 | 8/2001 | Galloway | |
| 6,302,969 | B2 | 10/2001 | Moster et al. | |
| 6,340,663 | B1 | 1/2002 | Deleo et al. | |
| 6,342,473 | B1 * | 1/2002 | Kott et al. | 510/357 |
| 6,358,900 | B1 | 3/2002 | Wigley et al. | |
| 6,372,701 | B2 | 4/2002 | Aszman et al. | |
| 6,399,553 | B1 | 6/2002 | Cable et al. | |
| 6,403,545 | B1 | 6/2002 | Karls et al. | |
| 6,432,897 | B1 * | 8/2002 | Cable | 510/182 |
| 6,491,728 | B2 | 12/2002 | Bacon et al. | |
| 6,521,578 | B1 * | 2/2003 | Stute et al. | 510/238 |
| 6,540,424 | B1 | 4/2003 | Hall et al. | |
| 6,569,261 | B1 | 5/2003 | Aubay et al. | |
| 6,593,288 | B2 | 7/2003 | Aubay et al. | |
| 6,649,580 | B2 | 11/2003 | Aszman et al. | |
| 6,664,218 | B1 | 12/2003 | Dastbaz et al. | |
| 6,667,287 | B2 | 12/2003 | Aszman et al. | |
| 6,703,358 | B1 | 3/2004 | Aubay et al. | |
| D488,386 | S | 4/2004 | Hall et al. | |
| 6,767,410 | B2 | 7/2004 | Aubay et al. | |
| D503,253 | S | 3/2005 | Rader et al. | |
| 6,881,711 | B1 | 4/2005 | Gershun et al. | |
| 6,893,180 | B2 | 5/2005 | Hall et al. | |
| 6,899,485 | B2 | 5/2005 | Hall et al. | |
| 6,964,535 | B2 | 11/2005 | Bell et al. | |
| 6,976,802 | B2 | 12/2005 | Hall et al. | |
| 6,986,618 | B2 | 1/2006 | Hall et al. | |
| 6,986,619 | B2 | 1/2006 | Hall et al. | |
| 6,995,128 | B2 | 2/2006 | Mitra et al. | |
| 7,004,658 | B2 | 2/2006 | Hall et al. | |
| 7,048,458 | B2 | 5/2006 | Hall et al. | |
| 7,098,181 | B2 | 8/2006 | Inoue et al. | |
| 2001/0044395 | A1 | 11/2001 | Aszman et al. | |
| 2002/0137658 | A1 * | 9/2002 | Faber | 510/470 |

(Continued)

FOREIGN PATENT DOCUMENTS

| | | | |
|---|---|---|---|
| DE | 2006/003336 | * | 7/2007 |
| DE | 102006003336 A1 | | 7/2007 |

(Continued)

OTHER PUBLICATIONS

PCT/US2010/002812 International Search Report dated Feb. 2, 2011.

*Primary Examiner* — Charles Boyer

(57) ABSTRACT

A multi-functional hard surface treating composition is described which includes (1) a surfactant system including at least two surfactants and (2) at least one alkylene glycol alkyl ether. The at least two surfactants include an anionic surfactant and either a polymer surfactant or a nonionic surfactant. The surfactant system and alkylene glycol alkyl ether have a synergistic effect to provide anti-fogging, anti-streaking, and cleaning benefits to a hard surface treated with the composition.

28 Claims, 2 Drawing Sheets

U.S. PATENT DOCUMENTS

| | | | | |
|---|---|---|---|---|
| 2003/0114345 | A1* | 6/2003 | Leonard et al. | 510/417 |
| 2003/0148913 | A1* | 8/2003 | Klinkhammer et al. | 510/421 |
| 2003/0180083 | A1 | 9/2003 | Hall et al. | |
| 2004/0213750 | A1 | 10/2004 | Bennett et al. | |
| 2004/0231700 | A1 | 11/2004 | Bell et al. | |
| 2005/0026802 | A1 | 2/2005 | Kilkenny et al. | |
| 2005/0215459 | A1* | 9/2005 | Policicchio et al. | 510/438 |
| 2005/0227898 | A1 | 10/2005 | Leskowicz et al. | |
| 2006/0052264 | A1 | 3/2006 | Lu | |
| 2007/0157953 | A1 | 7/2007 | Mahdi et al. | |
| 2007/0251545 | A1 | 11/2007 | Dreja et al. | |
| 2008/0279787 | A1 | 11/2008 | Cheung et al. | |
| 2008/0305978 | A1 | 12/2008 | Wietfeldt et al. | |
| 2010/0234269 | A1* | 9/2010 | Dreilinger et al. | 510/405 |

FOREIGN PATENT DOCUMENTS

| | | | |
|---|---|---|---|
| EP | 0527625 | A2 | 2/1993 |
| WO | 2005/114345 | * | 6/2003 |
| WO | 2005100522 | A1 | 10/2005 |

* cited by examiner

LOW VOC HARD SURFACE TREATING COMPOSITION PROVIDING ANTI-FOGGING AND CLEANING BENEFITS

CROSS REFERENCE TO RELATED APPLICATION

This application claims the benefit of U.S. Provisional Application No. 61/272,696 filed Oct. 22, 2009.

FIELD OF INVENTION

Hard surface treating compositions are described which have a low volatile organic content (VOC), and provide anti-fogging, cleaning and wipe-out benefits to a surface treated therewith. The provision of anti-fogging also relates to improvements as to reduced blooming or hazing. The compositions described are based on a synergistic effect between a surfactant system and glycol ether component which is enhanced through further combination with additional components.

BACKGROUND OF INVENTION

High solvent content is conventionally known to be beneficial in hard surface cleaning compositions since such provide for good cleaning as well as good wipe-out i.e., complete cleaning upon rubbing over a surface a paper or cloth towel or the like, usually by hand). Low VOC compositions, however, are desirable based on environmental considerations. To achieve a low VOC, solvents are removed from the cleaning compositions which then also results in a loss of the performance benefits obtained through the presence of the solvents.

Low VOC cleaning compositions therefor generally in the past have provided inferior cleaning. Based on this inferior cleaning ability, dirt remains behind on the surface treated which results in increased blooming and hazing over time and increased fogging under humid conditions, such as on mirrors in bathrooms due to steam from a shower or the like, or windows in homes or automobiles.

Accordingly, a hard surface treating composition having a low VOC and which provides good cleaning, wipe-out and anti-fogging would be beneficial.

SUMMARY OF INVENTION

The compositions of the invention are for treating hard surfaces and provide multiple benefits based on a particular combination of components present in low amounts. The compositions are environmentally friendly as being based on a low VOC and not requiring the presence of a chelator (such as monoethanolamine), and provide the beneficial properties of anti-fogging for an extended period of time, cleaning, wipe-out and reduced blooming (hazing) i.e., no rainbow effect over an extended period of time. Even though having significantly lower amounts of solvents as compared to conventional hard surface cleaning compositions, no loss of performance as to cleaning is present (rather improved cleaning is obtained) and the composition additionally has an increased beneficial effect as to anti-fogging and wipe-out. A low VOC is considered to be less than 4%, preferably less than 3%.

In a first non-limiting embodiment, the invention relates to an aqueous-based composition for treating hard surfaces. The composition includes a surfactant system including two or more surfactants, in combination with one or more glycol ethers. The glycol ether is preferably an alkylene glycol alkyl ether. The surfactant system includes an anionic surfactant and either a polymer surfactant or a nonionic surfactant. A polymer surfactant is preferred as allowing for the use of lower levels of glycol ether in the composition and enhancement of the anti-fogging and cleaning properties of the composition.

The composition of the first non-limiting embodiment further includes one or more solvents in a low amount in order that the composition have a low VOC and will avoid flash off of the composition from the surface being treated before the composition has a chance to clean the surface to which it has been applied. The solvent can be a combination of a conventional solvent as known for use in cleaning compositions which assist in cleaning and wipe-out, and a compound which serves as a solvent as well as a humectant, such as alkylene glycol.

A further component of the composition of the first non-limiting embodiment is a detergent compound which, in addition to having a cleaning function, can also be used to adjust the pH of the composition. To further enhance the activity of the composition components, a polymeric wetter compound is optionally included in the composition in order to render the surface being treated with the composition hydrophilic.

The solvent(s), detergent and, when present, the polymeric wetter serve to enhance the anti-fogging and cleaning benefits of the surfactant system and glycol ether.

A second non-limiting embodiment of a composition for treating hard surfaces according to the invention includes (1) a surfactant system including greater than 0 to about 1 wt. % of an anionic surfactant and either greater than 0 to about 1 wt. % of polymer surfactant or greater than 0 to about 1 wt. % of a nonionic surfactant; (2) greater than 0 to about 2 wt. % of an alkylene glycol alkyl ether; (3) greater than 0 to about 0.5 wt. % of a detergent; (4) about 0.2 to about 3 wt. % of at least one solvent; (5) about 0.1 to less than 1 wt. % of a solvent/humectant; (6) optionally about 0.05 to about 1 wt. % of a polymeric wetter; and (7) a balance of water as a carrier and diluent.

The compositions described herein preferably do not contain a chelator. The benefits obtained by this exclusion to the composition include a reduction in environmental impact of the formulation (i.e., a "greener" profile); reduced complexity of the formulation, as well as reduced cost of the formulation, while maintaining good anti-streaking and cleaning performance and overall acceptability.

The compositions described herein following use on a hard surface provide for anti-fogging of the surface for a number of days. This benefit shows improvement in cleaning due to the greater removal of dirt. The composition of the invention is humidity driven thereby providing good anti-fogging while also providing good cleaning and wipe-out. Generally, when increased humidity occurs, a low VOC of a composition has an effect on the wetting which in turn has an effect on the cleaning. The low VOC of the compositions of the invention, however, does not negatively impact wetting or cleaning. The composition of the invention is based on a combination of components which provide a cooperative action to provide a total effect, i.e., improvement or enhancement of properties, that is greater than the sum of the effects of the components taken individually. While the individual components provide singular benefits, the cooperative combination thereof as provided herein has been found to provide significant and surprisingly increased benefits and results over conventional glass and hard surface cleaning compositions.

BRIEF DESCRIPTION OF THE DRAWINGS

The following detailed description of specific non-limiting embodiments of the invention can be better understood when read in conjunction with the following drawings.

DETAILED DESCRIPTION OF THE INVENTION

Definitions

Figure 1:
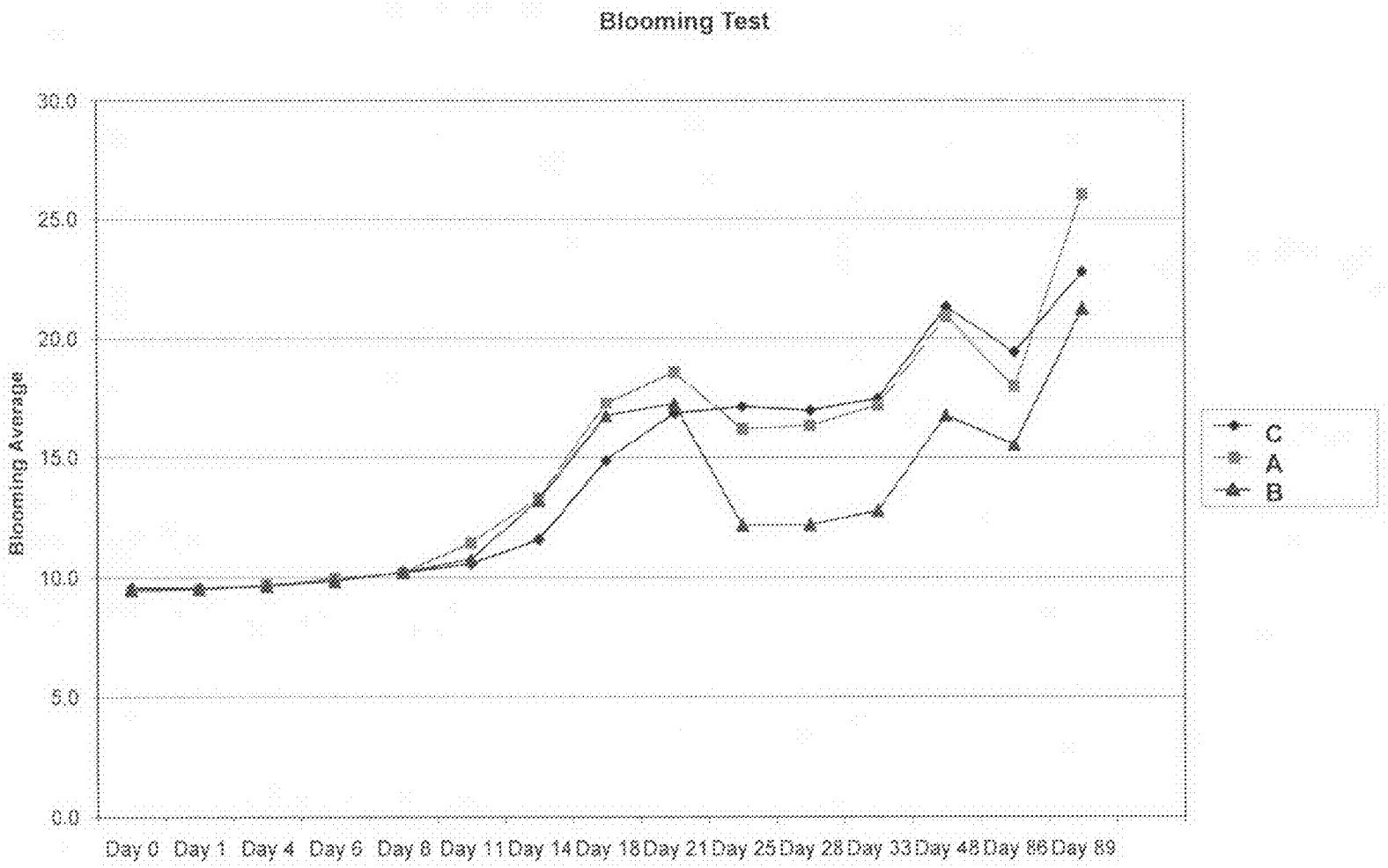
FIG. 1 is a graph showing the results of a blooming (hazing) test based on blooming average over time (days) as to inventive composition (A), a comparative composition (B) which includes the same ingredients as (A) except (B) does not contain the glycol ether component, and a further comparative composition (C) which is a commercially available glass cleaning composition sold under the name WINDEX®—Original Formula by S. C. Johnson & Son, Inc., Racine, Wis.

As used herein, "composition" refers to any liquid substance having more than one component.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of actual active ingredient in the total formula. For example, an off-the-shelf composition of Formula X may only contain 70% active ingredient X. Thus, 10 g. of the off-the-shelf composition only contains 7 g. of X. If 10 g. of the off-the-shelf composition is added to 90 g. of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. In another embodiment, a hard surface does not include silicon wafers and/or other semiconductor materials. Nonlimiting examples of ceramic surfaces include: toilet bowl, sink, shower, tile, the like, and combinations thereof. A nonlimiting example of a glass surfaces includes: window, mirror and the like. Nonlimiting examples of metal surfaces include: drain pipe, sink, automobiles, the like, and combinations thereof. Nonlimiting examples of a polymeric surface includes: PVC piping, fiberglass, acrylic, Corian®, the like, and combinations thereof. A nonlimiting example of a stone hard surface includes: granite, marble, and the like.

A hard surface may be any shape, size, or have any orientation that is suitable for its desired purpose. In one nonlimiting example, a hard surface may be a window which may be oriented in a vertical configuration. In another nonlimiting example, a hard surface may be the surface of a curved surface, such as a ceramic toilet bowl. In yet another nonlimiting example, a hard surface may be the inside of a pipe, which has vertical and horizontal elements, and also may have curved elements. It is thought that the shape, size and/or orientation of the hard surface will not affect the compositions of the present invention.

As used herein, "surfactant" refers to any agent that lowers the surface tension of a liquid, for example water. Exemplary surfactants which may be suitable for use with the present invention are described infra. In one embodiment, surfactants may be selected from the group consisting of anionic, nonionic, cationic, amphoteric, zwitterionic, and combinations thereof. In other nonlimiting embodiments, the surfactant may be a superwetter.

Compositions

The compositions of the invention are aqueous compositions for treating hard surfaces, and are especially beneficial with respect to glass surfaces. The compositions have a low volatile organic content (VOC) and have low residue. The compositions are based on a particular combination of components which have a synergistic effect. The compositions are multi-functional in that such provides anti-fogging and wipe-out which relate to improvements in cleaning and reduced blooming (hazing).

In a first non-limiting embodiment, the hard surface treating composition of the invention includes (a) a surfactant system including two or more surfactants, (b) a glycol ether, (c) detergent, (d) one or more solvents, (e) an alkylene glycol, (f) optionally a polymeric wetter and (g) water.

In a second non-limiting embodiment, the hard surface treating composition includes (a) a surfactant system including (i) an anionic surfactant and (ii) either a polymer surfactant or a nonionic surfactant; (b) an alkylene glycol alkyl ether; (c) a detergent which also serves to adjust the pH of the composition; (d) a solvent component including an alcohol; (e) an alkylene glycol; (f) optionally a polymeric wetter; and (g) water.

The surfactant system and glycol ether provide a synergistic effect which includes the provision of anti-fogging to surfaces treated with the composition. When the glycol ether is not present in the composition, a significant decrease in anti-fogging performance occurs. This also indicates a decrease in cleaning.

The surfactant system of the composition includes an anionic surfactant and at least one of a polymer surfactant or a nonionic surfactant. The polymer surfactant is not limited by its ionic nature. A polymer surfactant is preferred over a nonionic surfactant since it has been determined to enhance the effect of the anionic surfactant to a greater degree when the glycol ether is present in a low amount.

The anionic surfactant is used in an amount of greater than 0 to about 1 wt. %, preferably from about 0.3 to about 0.5 wt. % and most preferably about 0.4 wt. %. An exemplary anionic surfactant suitable for use is an alkali metal salt of a secondary alkane sulphonate (paraffin sulphonate). A preferred secondary alkane sulphonate salt is the alkali metal $C_{14-17}$ sec-alkyl sulphonate, having a formula of $CH_3(CH_2)_mCH(SO_3^-Na^+)(CH_2)_n—CH_3$, wherein m+n=10-14, such as sold under the tradename HOSTAPUR SAS 30 as sold by Clariant GmbH, Germany. Other anionic surfactants suitable for use include alkali metal salts of alkyl, alkenyl, alkylaryl sulphonates and sulfates; alkali metal $C_{6-18}$ alkyl ether sulfates, e.g., sodium lauryl ether sulfate; and α-olefin sulfonates. Some such anionic surfactants have a general formula $RSO_4M$ or $RSO_3M$ where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g., ammonium, sodium, potassium or lithium).

The polymer surfactant is present in an amount of from 0 to about 1 wt. %. A polymer surfactant has been found to beneficially enhance the performance of the anionic surfactant and be useful in combination with low levels of the glycol ether and still provide good results. A preferred polymer surfactant is sold under the tradename VIDET EGM by Vitech International, Inc., U.S.A. and is a biodegradable polymer surfactant system. The polymer surfactant suitable for use in the composition of the invention is not limited to a specific ionic nature. Due to the low VOC of the composition based on low amount level of solvents, the polymer surfactant is used to boost back the cleaning performance of the composition which was lost on removal of volatile organic solvents. This boost in performance is achieved because the composition does not evaporate so fast.

The nonionic surfactant is present in an amount of from 0 to about 1 wt. %, with a preferred range of about 0.4 to about 0.6 wt. %, and a most preferred amount of about 0.5 wt. %. The nonionic surfactant can be any nonionic surfactant as conventionally known for use in a hard surface cleaning composition. Preferred nonionic surfactants are alkyl polyglycosides. Alkylpolyglycosides suitable for use have the formula: $RO—(R'O)_x—Z_n$ where R is a monovalent alkyl radical containing 8 to 20 carbon atoms (the alkyl group may be straight or branched, saturated or unsaturated), O is an oxygen atom, R' is a divalent alkyl radical containing 2 to 4 carbon atoms, preferably ethylene or propylene, x is a number having an average value of 0 to 12, Z is a reducing saccharide moiety containing 5 or 6 carbon atoms, preferably a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647, which are incorporated herein by reference. Some exemplary alkyl polyglycosides are sold under the name GLUCOPON and are as follows (where Z is a glucose moiety and x=0):

Exemplary GLUCOPONS

| Product | N | R (# carbon atoms) |
|---|---|---|
| 425N | 2.5 | 8-14 |
| 425LF | 2.5 | 8-14 (10 w/w % star-shaped alcohol added) |
| 220UP | 2.5 | 8-10 |
| 225DK | 2.7 | 8-10 |
| 600UP | 2.4 | 12-14 |
| 215CSUP | 2.5 | 8-10 |

Other nonlimiting examples of nonionic surfactants suitable for use include alcohol ethoxylates including secondary alkanols condensed with $(OC_2H_4)$. Amine oxides are also suitable for use.

The glycol ether component which has a synergistic effect with the surfactant system is preferably an alkylene glycol alkyl ether. The alkylene is preferably ethylene or propylene and the alkyl group is preferably a $C_1$-$C_6$ carbon chain. Other glycol ethers suitable for use include mono- or di-alkyl ethers of alkylene glycols or polyalkylene glycols having up to 6 carbon atoms per glycol group and up to 6 carbon atoms in each alkyl group. A preferred example for use is ethylene glycol n-hexyl ether, also known as hexyl cellosolve. Other examples include propylene glycol n-butyl ether, dipropylene glycol n-butyl ether, propylene glycol n-propylene, dipropylene glycol n-propyl ether, diethylene glycol n-butyl ether, diethylene glycol methyl ether, dipropylene glycol methyl ether, and the like.

The glycol ether is present in an amount of from greater than 0 to about 2 wt. %. Preferably, the glycol ether is present in an amount of less than 1 wt. %. A preferred range for the glycol ether is about 0.5 to about 0.7 wt. %. The glycol ether is also an aid to providing the composition with good wipe-out.

A detergent is present in the composition in an amount of from greater than 0 to about 0.5 wt. %, with a preferred amount being about 0.3 wt. %. The detergent enhances cleaning by the composition and also preferably is a compound suitable for adjusting the pH of the composition. A preferred detergent, which also serves to adjust the pH of the composition, is ammonium hydroxide. Any detergent conventionally known for use in a hard surface cleaning composition is suitable for use in the composition so long as such is compatible with the other components of the composition.

One or more solvents are present in addition to the glycol ether component. The solvent component is present in a low amount so as to maintain a low VOC in the composition and yet still provide benefit to the composition by serving to enhance the properties of other components. Additionally, if the amount of solvent present is too high, the surface treating composition will flash off the surface before the composition has a chance to clean the surface to which it has been applied. The solvent component is preferably present in an amount of from about 0.2 to about 3 wt. %. A preferred range for the solvent is from about 0.25 to about 1 wt. %. Suitable solvents include $C_1$-$C_4$ aliphatic alcohols, preferably isopropyl alcohol, ethanol, and butanol.

The glycol component of the composition is preferably an alkylene glycol having up to 6 carbon atoms. Most preferably the glycol is propylene glycol or ethylene glycol. The glycol serves multiple functions of acting as a solvent, cleaner and humectant. The glycol is present in an amount of from about 0.1 to less than 1 wt. %. A preferred range for the glycol is from about 0.2 to about 0.5 wt. % and most preferably about 0.2 to about 0.3 wt. %.

The polymeric wetter of the composition acts to make the hard surface being treated hydrophilic, which enhances the action of the composition on the surface being treated, in particular in serving to extend the anti-fogging and cleaning benefits provided by the other components. Preferred polymeric wetters are sold by Rhodia Chimie under the tradename MIRAPOL SURF and are described in U.S. Pat. Nos. 6,593,288, 6,767,410, 6,703,358, and 6,569,261 and U.S. Published Patent Application No. 2006/0217286 A1. Suitable polymers as described therein include a monomer that is acidic and capable of forming an anionic charge; and contains a monomer with a permanent cationic charge or which is capable of forming a cationic charge upon protonation. A preferred MIRAPOL SURF polymer is MIRAPOL SURF S-210 which is an acrylamide acrylic polymer. Other examples of polymeric wetters are POLYQUART AMPHO 149 as sold by Cognis, which is an amphoteric aqueous solution of an acrylic polymer (CAS NO. 192003-74-0, and SOKALAN HP-70 as sold by BASF AG, Germany, which includes water soluble homo- and co-polymers, e.g. with vinylpyrrolidone, vinylimidiazole and nonionic monomers. While enhancing the action of the overall composition, the polymeric wetter is optionally present in the composition, When present, the polymeric wetter component is present in an amount of from about 0.05 to about 1 wt. %. The polymer provides a most preferred effect at about 0.4 wt. %, but good results are also obtained at a lower amount of about 0.1 wt. %. The polymer wetter is usually therefor used in a lower amount such as about 0.1 wt. % to reduce the cost of the composition.

The composition can also include one or more various adjuvants in minor amounts, such as fragrance(s), dye(s)/colorant(s), preservative(s) or the like. Such adjuvants can each be present in an amount greater than 0 to about 0.05 wt. %.

Water is present in the composition in an amount which provides for the balance of the composition to equal 100 wt. %. The water can be soft water, deionized water, reverse osmosis water or the like. Soft water is preferred.

A preferred formula of the hard surface treating composition of the invention is as follows:

TABLE 1

| Ingredient | Wt. % |
|---|---|
| $C_{1-4}$ Aliphatic Alcohol | ~0.2 to ~3 |
| Anionic Surfactant | >0 to ~1 |
| Polymer Surfactant or Nonionic Surfactant | 0 to ~1 |
| Alkylene Glycol Alkyl Ether | >0 to ~2 |
| Polymer Wetter | 0 to ~1 |
| Detergent | >0 to ~0.5 |
| Alkylene Glycol | ~0.1 to <1 |
| Water | Balance |
| | 100% |

A more preferred formula of a hard surface treating composition of the invention is as follows:

TABLE 2

| Ingredient | Wt. % |
|---|---|
| $C_{1-4}$ Aliphatic Alcohol | ~0.25 to ~1.0 |
| Anionic Surfactant | ~0.3 to ~0.5 |
| Polymer Surfactant or Nonionic Surfactant | ~0.4 to ~0.5 |
| Alkylene Glycol Alkyl Ether | ~0.5 to ~0.7 |
| Polymer Wetter | ~0.05 to ~0.4 |
| Detergent | ~0.25 to ~0.35 |
| Alkylene Glycol | ~0.2 to ~0.3 |
| Water | Balance |
| | 100% |

A most preferred formulas for the hard surface treating composition of the invention is as follows:

TABLE 3

| Ingredients | Wt. % |
|---|---|
| Isopropyl alcohol | 1.0 |
| Secondary alkane sulphonate, sodium salt (30%) | 0.4 (0.12) |
| VIDET EGM Polymer surfactant | 0.5 |
| Hexyl Cellosolve | 0.6 |
| MIRAPOL SURF S-210 | 0.1 |
| Ammonium hydroxide (30%) | 0.3 (0.09) |
| Propylene Glycol | 0.25 |
| Fragrance | 0.05 |
| Soft Water | 96.8 |
| | 100% |

TABLE 4

| Ingredients | Wt. % |
|---|---|
| Isopropyl alcohol | 0.5 |
| Secondary alkane sulphonate, sodium salt (30%) | 0.4 (0.12) |
| VIDET EGM Polymer surfactant | 0.1 |
| Hexyl Cellosolve | 0.6 |
| MIRAPOL SURF S-210 | 0.1 |
| Ammonium hydroxide (30%) | 0.3 (0.09) |
| Propylene Glycol | 0.25 |
| Fragrance | 0.05 |
| Soft Water | 97.7 |
| | 100% |

The hard surface treating composition of the invention provides for no fogging of the treated surface for days after cleaning the surface, such as glass or a mirror, with the composition. This benefit demonstrates also that the composition is removing more dirt, i.e., provides improved cleaning. The anti-fogging properties are shown by the blooming associated with the composition following treatment of a surface with the composition. No rainbow effect on the treated surface is present for an extended period of time. To illustrate the anti-fogging benefit of the compositions of the invention, as well as the synergistic nature of the combination of the glycol ether and surfactant system, a comparative Blooming (hazing) test was run using a composition of the formula of Table 3 above (denoted as A), a formula identical to that in Table 3 except that no hexyl cellosolve (ethylene glycol n-hexyl ether) was present (denoted as B) and a commercial glass cleaner sold under the tradename WINDEX®—Original Formula, by S. C. Johnson & Son, Inc., Racine, Wis. (denoted as C). The results of this Blooming test are shown graphically in FIG. 1 based on blooming average over a number of days (from 0 to 89). The results of the test show that inventive composition A is humidity driven which indicates that good anti-fogging properties are obtained, as well as good wipe-out and cleaning.

More specifically, FIG. 1 shows that the formula of B dropped as to blooming between days 21 and 25 due to increase in humidity (such as present in a bathroom when steam forms from a shower). The formula of A, however, did not drop indicating significant improvement in performance and that it was humidity driven.

Figure 2:
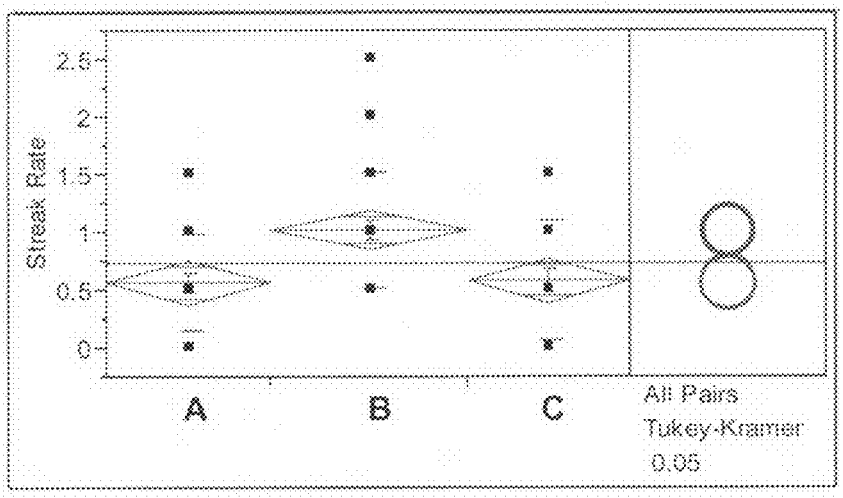
FIG. 2 is a graph showing a comparison of the streak rate of compositions (A), (B) and (C), as described above in relation to FIG. 1, showing that compositions (A) and (C) have comparable streak rates but that composition (B) has a higher streak rate.

Further, a comparative test was run between the same three formulas A, B and C, as described above with respect to FIG. 2, to determine the rate of streaking and, thus, level of wipe-out. The streak rate is based on values 0 to 5, wherein 0 indicates no streaks and 5 indicates totally streaked. As shown in FIG. 2, inventive formula A is comparable to commercial formula C. Formula B, not including the glycol ether includes a greater amount of streaking.

To further appreciate the enhanced multiple benefits of the compositions of the invention, comparison testing was conducted between two compositions of the invention denoted as Invention A and corresponding to the formula as set forth in Table 4 and denoted as Invention B and corresponding to the formula as set forth in Table 3 above, and various commercial glass cleaning products as identified below. Even though other commercial products contain some of the same or similar components, the compositions of the invention provide for enhanced cleaning, anti-streaking and anti-fogging (e.g. reduced blooming and hazing) while having a low VOC. Product testing conducted on the compositions was the same for each composition as described below.

SPARKLE Glass Cleaner (Sparkle)

| Ingredients | Wt. % (unless otherwise noted) |
|---|---|
| Ethylene Glycol Monobutyl Ether* | 6.8 |
| Volatile Acid | 0.0004 meq/g |
| Ethoxylated Fatty Alcohol | 0.11 |
| Polyglycol Polymer | 0.03 |
| Fragrance* and $H_2O$ | Balance |

pH = 4.2

*Considered a VOC

GLASS PLUS Glass Cleaner (Glass Plus)

| Ingredients | Wt. % |
|---|---|
| Propylene Glycol Monomethyl Ether* | 0.7 |
| Propylene Glycol Monobutyl Ether* | 0.9 |
| Di-n-Butyl Ether* | 0.1 |
| Alkyl Polyglycoside (APG) | 0.16 |

-continued

| Ingredients | Wt. % |
|---|---|
| Alkyl Sulfate Salt | 0.04 |
| EDTA Salt and Sodium Carbonate | 0.05 |
| Fragrance* and Water | Balance |

pH = 10.6

*Considered a VOC

GREAT VALUE Glass Cleaner (Great Value)(Walmart)

| Ingredients | Wt. % |
|---|---|
| Ammonia | 0.09 |
| Ethylene Glycol Monobutyl Ether* | 0.09 |
| Di-n-Butyl Ether* | 0.1 |
| APG | 0.22 |
| EDTA Salt and Sodium Carbonate | 0.15 |
| Fragrance* and Water | Balance |

pH = 10.6

*Considered a VOC

GREENWORKS Glass and Surface Cleaner (Greenworks Glass and Surface)

| Ingredients | Wt. % |
|---|---|
| Ethanol* | 2.0 |
| APG | 0.65 |
| Sodium Carbonate and Bicarbonate | 0.15 |
| Fragrance* and Water | Balance |

pH = 6.9

*Considered a VOC

GREENWORKS Glass Cleaner (Greenworks Glass)

| Ingredients | Wt. % |
|---|---|
| Ethanol* | 2.1 |
| APG | 0.55 |
| Sodium Carbonate & Sodium Bicarbonate | 0.55 |
| Fragrance* and Water | Balance |

pH = 11.3

*Considered a VOC

409 Glass Cleaner (409 Glass)

| Ingredients | Wt. % |
|---|---|
| Propylene Glycol Propyl Ether* | 1.0 |
| Fatty Hydroxyalkylamide | 0.05 |
| Lauryl Isopropanolamide | 0.10 |
| EDTA Salt and Mixture of Hydroxy Acid Salts | |
| Fragrance* and Water | Balance |

pH = 11.3

*Considered a VOC

UP AND UP Glass Cleaner (Up and Up)(Target)

| Ingredients | Wt. % |
|---|---|
| Ammonia | 0.09 |
| Ethylene Glycol Monobuytl Ether* | 1.1 |
| Ethanol* | 2.6 |
| Hexylene Glycol Monobutyl Ether* | 0.5 |
| Ethoxylated Fatty Alcohol | 0.05 |
| Fatty Alkyl Benzene Sulfonate Salt | 0.05 |
| Lower Alkyl Aryl Sulfonate Salt | 0.03 |
| EDTA Salt and Sodium Bicarbonate | 0.03 |
| Fragrance* and Water | Balance |

pH = 10.6

*Considered a VOC

SHINE Glass Cleaner (Shine Glass)

| Ingredients | Wt. % |
|---|---|
| Ammonia | 0.008 |
| Propylene Glycol Propyl Ether* | 2.3 |
| APG | 0.11 |
| Aminopolycarboxylic Acid Salt | 0.03 |
| Fragrance* and Water | Balance |

pH = 10.6

*Considered a VOC

METHOD Glass Cleaner (Method Glass)

| Ingredients | Wt. % |
|---|---|
| Ammonia | 0.006 |
| Ethanol* | 2.4 |
| Propylene Glycol Monomethyl Ether* | 0.9 |
| Dipropylene Glycol* | 0.02 |
| Hexylene Glycol* | 0.01 |
| Ethoxylated Fatty Alcohol | 0.01 |
| Alkyl Sulfate Salt | 0.09 |
| EDTA Salt and Sodium Bicarbonate | 0.05 |
| Fragrance* and Water | Balance |

pH = 8.8

*Considered a VOC

The test protocol used for the above products and the compositions of the invention was the same and is set forth below under the titles "Streak Test Protocol" and "Interior Soil Test Protocol" below. The results of the tests are set forth in Table 5 thereafter.

STREAK TEST

Glass cleaners are used most frequently on windows. Windows are also the most often cited surface where streaking is noticed. Thus, the test method compares the streaking performance of glass cleaner formulas on windows.

Streaks on windows are most easily detected when the streak is illuminated from behind with a bright light and is viewed against a dark background. This situation occurs naturally early or late in the day when the sun is at a low angle to the horizon and shines directly through a window. This situation is simulated in the streak test by back lighting clear glass panes with a bright, direct light source and viewing the glass panes against a dark surface.

12"×12"×⅛" double strength quality clear float window glass with swiped edges, Q1 Quality (ASTM C1036. Standard specification for flat glass), were used. A viewing stand for holding at least one of the 12"×12"×⅛" glass plates at eye level was used. The lighting equipment used was an ETC Sensor Lighting control system, model SR-12, ETC Acclaim 100 series, 24 channel light board, Model 124, ETC Source Four Ellipsoidal Spotlight Model 436, and HPL 575 Halogen Lamps. The ETC Source Four Lights were placed on a lighting pole. The glass plate viewing stand was placed 36 inches in front of the lighting pole. The Light was shined on the area of the viewing stand that holds the glass plate. The angle of the light was between 25 to 30 degrees. The focus of the light was on the viewing stand so that a crisp image was obtained. The glass plates were placed in the viewing stands, all ambient lights were turned off, and a light meter used to measure the light intensity. The light meter was held parallel to the front surface of the glass plate, and the meter activated for a minimum of 1½ seconds to measure the intensity of light reflecting through the glass plate. All Lights were adjusted so that all light intensities were matched between 900 to 1100 fcd (foot candles).

To insure a uniform testing surface all plates were squeegeed with a 10% solution of WINDEX®—Original Formula glass cleaner. Once all plates had been prepared and product uniformly applied, the product wiped from the plate and the plate evaluated. The cleaned glass plates were set into the viewing stand and placed behind a template. Ambient lighting was turned off and the lighting equipment turned on. The glass in the holder was placed in a black box with lighting and photocopied. For a blooming test, black box evaluations were taken every week. The test concludes on week four after the black box evaluation and final visual evaluation. As noted above, the test results are set forth in Table 5 below.

Interior Soil Test

Glass cleaners are used most frequently on windows. Windows are also the most often cited surface where fingerprints are noticed. The test method compares the cleaning performance of glass cleaner formulas on windows.

Fingerprints on windows are most easily detected when the soil is illuminated from behind with a bright light and is viewed against a dark background. This situation is often created naturally early or late in the day when the sun is at a low angle to the horizon and shines directly through a window. This situation can be simulated in the laboratory by back lighting clear glass panes with a bright, direct light source and viewing the glass panes against a dark surface.

12"×12"×⅛" double strength quality clear float window glass with swiped edges, Q1 Quality (ASTM C1036. Standard specification for flat glass), were used. A viewing stand was provided for holding at least one 12"×12"×⅛" glass plate at eye level. Lighting equipment used was an ETC Sensor Lighting Control System, model SR-12, ETC Acclaim 100 Series, 24 channel light board, Model 124, ETC Source Four Ellipsoidal Spotlight Model 436, and HPL 575 Halogen Lamps. The ETC Source Four Lights were placed on a lighting pole. The glass plate viewing stand was placed 36 inches in front of lighting pole. The light was tilted so that it shined on the area of the viewing stand that held the glass plate. The angle of the light was between 25 to 30 degrees. The focus of the light was adjusted on the viewing stand so that a crisp image was obtained.

The glass plates were placed in the viewing stands, all ambient lights turned off, and a light meter used to measure the light intensity. The meter was activated for a minimum of 1½ seconds to measure the intensity of light reflecting through the glass plate. All Lights were adjusted so that all light intensities were matched between 900 to 1100 fcd.

To insure a uniform testing surface, all plates were squeegeed with a 10% solution of WINDEX®—Original Formula. This was performed on dry, or nearly dry glass plates. Once the plates had been prepared, the glass was placed in the viewing stand with direct back lighting.

Interior soil for application to the glass for the test was prepared having the following composition—

| Raw Material | % |
|---|---|
| Kaopaque-10 Clay | 11.12 |
| Heavy Mineral Oil | 44.44 |
| Synthetic Sebum | 44.44 |
| Total | 100.00 |

Following uniform application of the soil in a circle on the glass, two complete trigger pulls from identical pump containers of each test product was sprayed onto the glass surface to cover the soiled circle. A 20 second dwell time was provided for the test products. The product and soil were removed and the templates were placed into the viewing stand and the cleaned glass plate was placed behind a template. The ambient lighting was turned off and the lighting equipment turned on.

The glass was placed in a black box for evaluation. Lights in the black box were turned on and the lights totally warmed up (15 minutes). The glass was photographed. The average for each side was recorded. The results are set forth in Table 5 below.

TABLE 5

| Product | VOC | Streak Rate | IS* Rate | Bloom Rate | Steamed Rate |
|---|---|---|---|---|---|
| Sparkle | 6.8 | 1.68 | 4.86 | 3.3 | 3.5 |
| Glass Plus | 1.6 | 0.48 | 1.88 | 2.8 | 1.3 |
| Great Value | 0.9 | 1.26 | 1.3 | 1.1 | 0.5 |
| Greenworks Glass & Surface | 2.0 | 1.24 | 1.54 | 1.8 | 0.6 |
| Greenworks Glass | 2.1 | 3.2 | 2.06 | 1.1 | 0.8 |
| 409 Glass | 1.0 | 0.3 | 1.04 | 1.9 | 2.7 |
| Up & Up Glass | 3.7 | 0.24 | 2 | 2.4 | 0.8 |
| Shine Glass | 2.3 | 2 | 2.42 | 1.6 | 0.6 |
| Method Glass | 3.3 | 0.52 | 4.46 | 3 | 0.4 |
| Invention A | 0.5 | 0.18 | 1.54 | 3.8 | 0.8 |
| Invention B | 1.6 | 0.3 | 1.50 | 3.1 | 0.5 |

Invention A = Composition as set forth in Table 4 above.
Invention B = Composition as set forth in Table 3 above.
*IS = Interior Soil.

The compositions of the invention are for treating hard surfaces and provide multiple benefits based on a particular combination of components present in low amounts. The compositions are environmentally friendly as being based on a low VOC, and provide the beneficial properties of anti-fogging for an extended period of time, cleaning, wipe-out and reduced blooming (hazing), i.e., no rainbow effect over an extended period of time. Even though having significantly lower amounts of solvents as compared to conventional hard surface cleaning compositions, no loss of performance as to cleaning is present (rather improved cleaning is provided) and the composition additionally has an increased beneficial effect as to anti-fogging and wipe-out.

It is noted that terms like "specifically," preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The values disclosed herein are not to be understood as being strictly limited to the exact numerical values recited. Instead, unless otherwise specified, each such value is intended to mean both the recited value and a functionally equivalent range surrounding that value. For example, a value disclosed as "50 wt. %" is intended to mean "about 50 wt. %."

All documents cited in the Detailed Description of the invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention.

It is claimed:

1. A multi-functional hard surface treating composition consisting essentially of (a) a surfactant system including at least two surfactants wherein at least one of said surfactants is an anionic surfactant present in an amount greater than zero to about 1 wt. % and at least one of said surfactants is either a polymer surfactant present in an amount greater than zero to about 1 wt. % or a nonionic surfactant present in an amount greater than zero to about 1 wt. %;

(b) at least one alkylene glycol alkyl ether in an amount of greater than zero to about 2 wt. % wherein the alkylene has up to 6 carbon atoms and the alkyl has a $C_{1-6}$ carbon chain length;

(c) at least two solvents in an amount of about 0.3 to less than 4 wt. % including an alcohol in an amount of about 0.2 to about 3 wt. % and a glycol, wherein said glycol is present in an amount of about 0.1to less than 1 wt. % and is a different component from said alcohol and is not a glycol ether;

(d) at least one detergent different from the surfactants in component (a) in an amount greater than zero to about 0.5 wt. %;

(e) greater than zero to about 1·wt. % of a polymeric wetter compound;

(f) zero to about 0.05 wt. % of one or more adjuvants; and (g) a balance of 100 wt. % of water as a carrier;

wherein said composition has a volatile organic content (VOC) of less than 4%;

wherein said composition lessens fogging on a hard surface treated with said composition to a greater degree than said composition in absence of said at least one alkylene glycol alkyl ether; and wherein said composition does not include a chelator and does not include monoethanolamine.

2. The composition of claim 1, wherein said anionic surfactant of (a) is present in an amount of about 0.3 to about 0.5 wt. %; said polymer surfactant of (a) when present is present in an amount of about 0.4 to about 0.5 wt. %; said nonionic surfactant when present is present in an amount of about 0.4 to about 0.5wt. %; said at least one alkylene glycol alkyl ether is present in an amount of greater than 0 and less and 1 wt. %; said at least two solvents are present in an amount of about 0.45 to about 1.5 wt. % wherein said alcohol is present in an amount about 0.25 to about 1 wt. % and said glycol is present in an amount of about 0.2 to about 0.5 wt. %; said detergent compound is present in an amount greater than 0 to about 0.3wt. %; said polymeric wetter compound is present in an amount of about 0.1 to about 0.4 wt. %; said one or more adjuvants when present are each present in amount of greater than 0 to about 0.05 wt. %; and said water is present in a balance amount to 100 wt. %.

3. The composition according to claim 1, wherein said alcohol is a $C_{1-4}$ aliphatic alcohol.

4. The composition according to claim 1, wherein said glycol is an alkylene glycol.

5. The composition according to claim 1, wherein said anionic surfactant is one or more of an alkali metal salt of a secondary alkane sulphonate, an alkali metal salt of alkyl sulphonate, an alkali metal salt of alkenyl sulphonate, an alkali metal salt of alkylaryl sulphonate, an alkali metal salt of alkyl sulfate, an alkali metal salt of alkenyl sulphate, an alkali metal salt of alkylaryl sulphate, an alkali metal $C_{6-18}$ alkyl ether sulfate, and an $\alpha$-olefin sulfonate.

6. The composition of claim 1, wherein said polymer surfactant is a biodegradable polymer.

7. The composition of claim 1, wherein said nonionic surfactant is one or more of an alkyl polyglycoside, alcohol ethoxylate or amine oxide.

8. The composition of claim 1, wherein said glycol ether is one or more of a monoalkyl or dialkyl ether of alkylene glycol or polyalkylene glycol.

9. The composition of claim 1, wherein said detergent is ammonium hydroxide.

10. The composition of claim 1, wherein said polymeric wetter compound is an acrylamide acrylic polymer, an amphoteric aqueous solution of an acrylic polymer, homo- or co-polymers of vinylpyrrolidone, or homo- or co-polymers of vinylimidiazole.

11. The composition according to claim 1, wherein said VOC is less than 1%.

12. A multi-functional hard surface treating composition comprising (a) about 0.2 to about 3 wt. % of a $C_{1-4}$ aliphatic alcohol;

(b) greater than 0 to about 1 wt. % of an anionic surfactant;

(c) greater than 0 to about 1 wt. % of either a polymer surfactant or a nonionic surfactant;

(d) greater than 0 to 2 wt. % of an alkylene glycol alkyl ether;

(e) greater than 0 to about 0.5 wt. % of a detergent compound different from the surfactants in components (b) and (c);

(f) about 0.1 to less than 1 wt. % of alkylene glycol, wherein said alkylene glycol is not a glycol ether;

(g) about 0.05 to about 1 wt. % of a polymeric wetter compound;

(h) optionally, one or more adjuvants; and (i) water present in a balance amount to 100 wt. %;

wherein said composition has a volatile organic content (VOC) of less than 4%;

wherein said composition lessens fogging on a hard surface treated with said composition to a greater degree than said composition in absence of said at least one alkylene glycol alkyl ether; and wherein said composition does not include a chelator and does not include monoethanolamine.

13. The composition of claim 12, wherein said $C_{1-4}$ aliphatic alcohol is present in an amount of about 0.25 to about 1 wt. %; said anionic surfactant is present in an amount of about 0.3 to about 0.5 wt. %; said polymer surfactant when present is present in an amount of about 0.4 to about 0.5 wt. %; said nonionic surfactant when present is present in an amount of about 0.4 to about 0.5wt. %; said alkylene glycol alkyl ether is present in an amount of about 0.5 to about 0.7 wt. %; said detergent compound is present in an amount of about 0.25 to about 0.35wt. %; said alkylene glycol is present in an amount of about 0.2 to about 0.3 wt. %; said polymeric wetter compound is present in an amount of about 0.1 to about 0.4wt. %; said one or more adjuvants when present are each present in amount of greater than 0 to about 0.05 wt. %; and said water is present in a balance amount to 100 wt. %.

14. The composition according to claim 12, wherein said VOC is less than 1%.

15. The composition according to claim 12, wherein said anionic surfactant is one or more of an alkali metal salt of a secondary alkane sulphonate, an alkali metal salt of. alkyl sulphonate, an alkali metal salt of alkenyl sulphonate, an alkali metal salt of alkylaryl sulphonate, an alkali metal salt of alkyl sulfate, an alkali metal salt of alkenyl sulphate, an alkali metal salt of alkylaryl sulphate, an alkali metal $C_{6-18}$ alkyl ether sulfate, and an a-olefin sulfonate.

16. The composition of claim 12, wherein said polymer surfactant is a biodegradable polymer.

17. The composition of claim 12, wherein said nonionic surfactant is one or more of an alkyl polyglycoside, alcohol ethoxylate or amine oxide.

18. The composition of claim 12, wherein said alkylene glycol alkyl ether includes an alkylene having up to 6 carbon atoms and the alkyl has a $C_{1-6}$ carbon chain length.

19. The composition of claim 12, wherein said detergent is ammonium hydroxide.

20. The composition of claim 12, wherein said polymeric wetter compound is an acrylamide acrylic polymer, an amphoteric aqueous solution of an acrylic polymer, homo- or co-polymers of vinylpyrrolidone, or homo- or co-polymers of vinylimidiazole.

21. A multi-functional hard surface treating composition consisting of:

(a) about 0.2 to about 3 wt. % of a Cl-4 aliphatic alcohol;
(b) greater than 0 to about 1 wt. % anionic surfactant;
(c) greater than 0 to about 1 wt. % polymer surfactant or a nonionic surfactant;
(d) greater than 0 to about 2 wt. % alkylene glycol alkyl ether;
(e) greater than 0 to about 0.5 wt. % detergent different from the surfactants in components (b) and (c);
(f) about 0.01 to less than 1 wt. % glycol compound, wherein said glycol is a different component from said glycol ether;
(g) optionally about 0.05 to about 1 wt. % polymeric wetter compound;
(h) optionally one or more adjuvants selected from the group consisting of fragrances, dyes, colorants and preservatives; and
(i) water in a balance amount to 100 wt. %; and wherein said composition lessens fogging on a hard surface treated with said composition to a greater degree than said composition in absence of said at least one alkylene glycol alkyl ether; and wherein said composition does not include a chelator.

22. The composition according to claim 21, wherein said composition has a volatile organic content (VOC) of less than 1.

23. A multi-functional hard surface treating composition consisting of:

(a) about 0.2 to 3 wt. % of a Cl-4 aliphatic alcohol;
(b) greater than 0 to about 1 wt. % anionic surfactant;
(c) greater than 0 to about 1 wt. % polymer surfactant or a nonionic surfactant;
(d) greater than 0 to about 2 wt. % alkylene glycol alkyl ether;
(e) greater than 0 to about 0.5 wt. % detergent;
(f) about 0.01 to less than 1 wt. % glycol compound;
(g) optionally about 0.05 to about 1 wt. % polymeric wetter compound;
(h) optionally one or more adjuvants; and
(i) water in a balance amount to 100 wt.%; wherein said C1-4aliphatic alcohol is isopropyl alcohol; said anionic surfactant is an alkali metal salt of a secondary alkane sulphonate; said polymer surfactant is a biodegradable polymer surfactant; said alkylene glycol alkyl ether is ethylene glycol n-hexyl ether; said polymeric wetter compound is an acrylamide acrylic polymer; said detergent is ammonium hydroxide; and said glycol compound is an alkylene glycol.

24. The composition according to claim 21, wherein said anionic surfactant is one or more of an alkali metal salt of a secondary alkane sulphonate, an alkali metal salt of alkyl sulphonate, an alkali metal salt of alkenyl sulphonate, an alkali metal salt of alkylaryl sulphonate, an alkali metal salt of alkyl sulfate, an alkali metal salt of alkenyl sulphate, an alkali metal salt of alkylaryl sulphate, an alkali metal $C_{6-18}$ alkyl ether sulfate, and an a-olefin sulfonate.

25. The composition of claim 21, wherein said polymer surfactant is a biodegradable polymer.

26. The composition of claim 21, wherein said alkylene glycol alkyl ether includes an alkylene having up to 6 carbon atoms and the alkyl has a $C_{1-6}$ carbon chain length.

27. The composition of claim 21 wherein said detergent is ammonium hydroxide.

28. The composition of claim 21, wherein said polymeric wetter compound is an acrylamide acrylic polymer, an amphoteric aqueous solution of an acrylic polymer, homo- or co-polymers of vinylpyrrolidone, or homo- or co-polymers of vinylimidiazole.

* * * * *